US006750461B2

(12) United States Patent
Fink et al.

(10) Patent No.: US 6,750,461 B2
(45) Date of Patent: Jun. 15, 2004

(54) LARGE AREA ELECTRON SOURCE

(75) Inventors: Richard Lee Fink, Austin, TX (US); Leif Thuesen, Austin, TX (US)

(73) Assignee: SI Diamond Technology, Inc., Austin, TX (US)

( * ) Notice: Subject to any disclaimer, the term of this patent is extended or adjusted under 35 U.S.C. 154(b) by 0 days.

(21) Appl. No.: 10/262,997

(22) Filed: Oct. 2, 2002

(65) Prior Publication Data

US 2003/0062488 A1 Apr. 3, 2003

Related U.S. Application Data

(60) Provisional application No. 60/330,358, filed on Oct. 18, 2001, and provisional application No. 60/326,868, filed on Oct. 3, 2001.

(51) Int. Cl.[7] ..... H01J 33/00

(52) U.S. Cl. ..... 250/492.3; 250/492.1; 250/423 F; 250/423 R; 250/494.1; 313/351; 313/309; 313/495

(58) Field of Search ..... 250/492.3, 493.1, 250/494.1, 423 R, 423 F, 426; 445/50; 313/309, 336, 351, 409, 422, 495, 497

(56) References Cited

U.S. PATENT DOCUMENTS

| | | | | |
|---|---|---|---|---|
| 5,003,178 A | | 3/1991 | Livesay | 250/492.3 |
| 5,414,267 A | | 5/1995 | Wakalopulos | 250/492.3 |
| 5,557,163 A | | 9/1996 | Wakalopulos | 313/420 |
| 5,909,032 A | | 6/1999 | Wakalopulos | 250/492.3 |
| 6,163,107 A | * | 12/2000 | Itoh et al. | 313/309 |

* cited by examiner

*Primary Examiner*—Nikita Wells
*Assistant Examiner*—James P. Hughes
(74) *Attorney, Agent, or Firm*—Kelly K. Kordzik; Winstead Sechrest & Minick P.C.

(57) ABSTRACT

By using a large area cathode, an electron source can be made that can irradiate a large area more uniformly and more efficiently than currently available devices. The electron emitter can be a carbon film cold cathode, a microtip or some other emitter. It can be patterned. The cathode can be assembled with electrodes for scanning the electron source.

6 Claims, 8 Drawing Sheets

LARGE AREA ELECTRON SOURCE

CROSS REFERENCE TO RELATED APPLICATIONS

The present application claims priority to U.S. Provisional Patent Applications Serial Nos. 60/326,868 filed Oct. 3, 2001 and 60/330,358 filed Oct. 18, 2001.

TECHNICAL FIELD

The present invention relates in general to sources of electrons, and in particular, to an electron beam source.

BACKGROUND INFORMATION

Electron beams can be used to sterilize medical instruments, food and packaging. Irradiation by electrons is an accepted medical treatment for certain skin cancers. Environmental uses are cleaning flue gasses and decontamination of medical waste. Industrial applications are drying of inks and polymer crosslinking.

Referring to FIG. 1, an electron source 100 generally consists of a hot filament 101 maintained at high voltage inside of a vacuum tube 102 and an exit window 103. Because the window 103 is a fragile, thin foil, it must be somewhat small in size so that it does not tear under air pressure present due to the vacuum in the tube 102.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
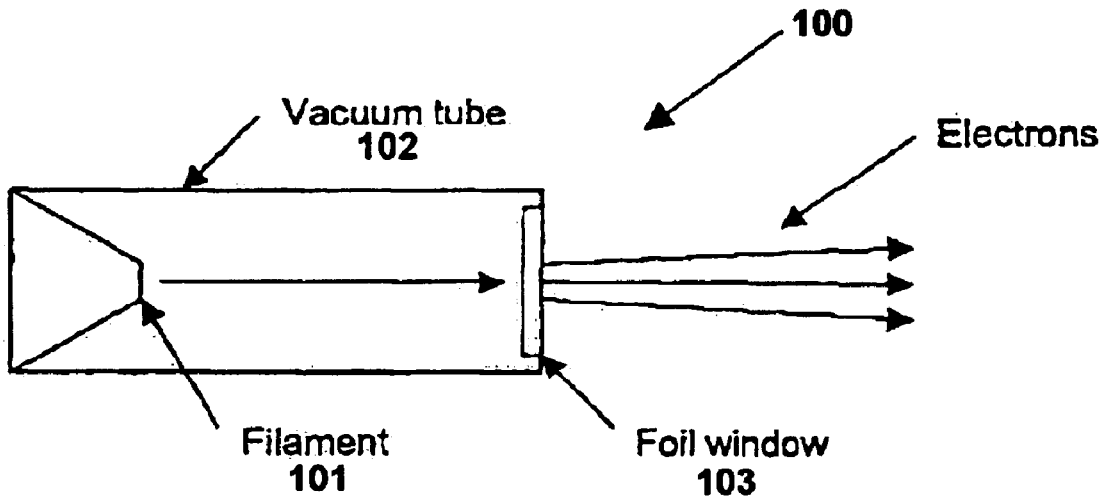
FIGURE 1 PRIOR ART
FIG. 1 illustrates a prior art electron source.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

In applications for electron beams such as those mentioned above, a large, uniform source is desirable. A uniform, large area beam would allow quicker processing of the items being irradiated. More important, the dose calibration would be made simpler.

To make a large, uniform source of electrons, a flat, large area cathode can be used such that many sources of electrons are available to many windows. This can be done in different ways. In all of the following embodiments, any cold cathode emitter could be utilized, such as a carbon cold cathode, a micro-tip array, a film of carbon nanotubes, amorphic diamond emitters, etc.

Figure 2:
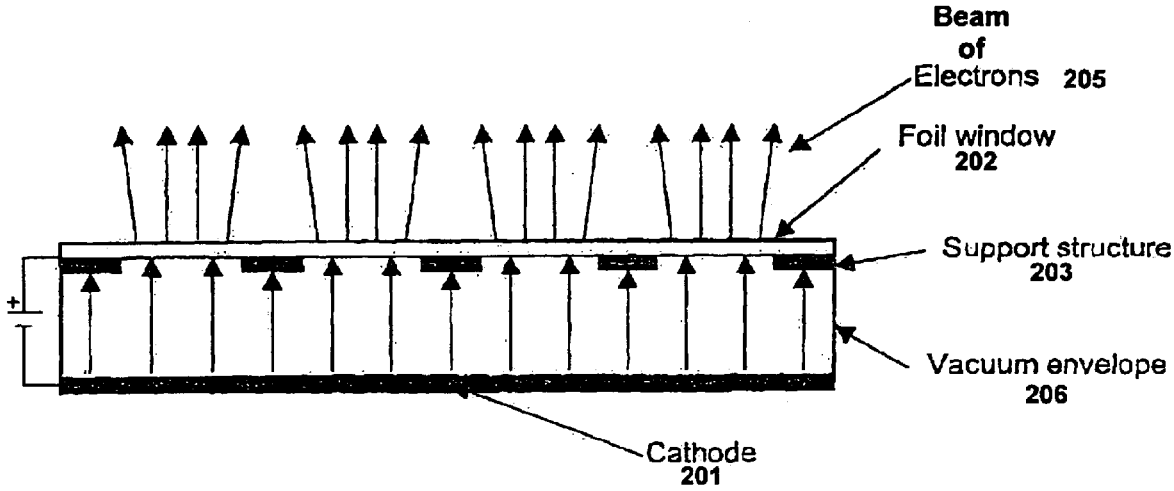
FIG. 2 illustrates a large area cathode electron source.

Referring to FIG. 2, the cathode 201 can be a blanket emitter with a large, metal foil window 202 with a support structure 203. A voltage source can be utilized to create an electric field to extract electrons from the cathode 201 through the foil windows 202 to create the beam of electrons 205 to irradiate a large area. Vacuum envelope 206 may encase the cathode 201 with the support structure 203.

Figure 3:
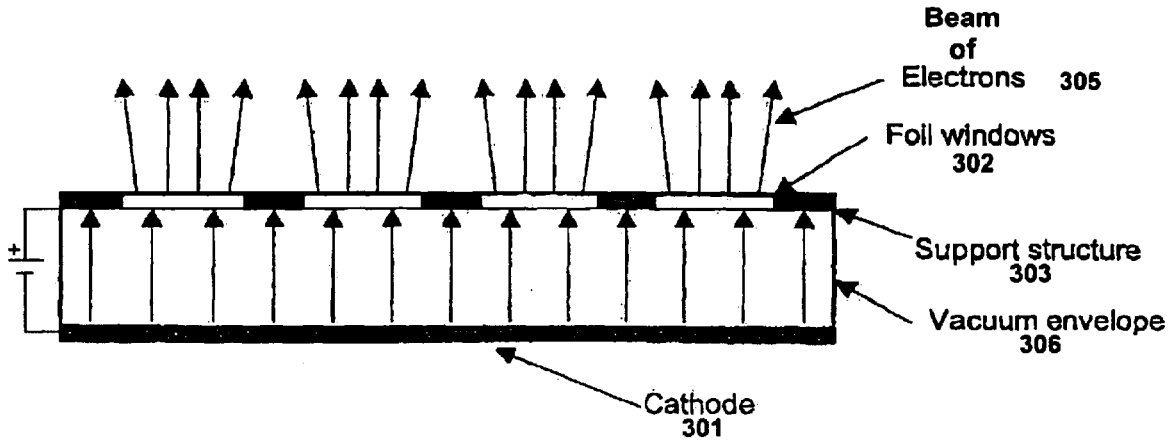
FIG. 3 illustrates another large area cathode electron source.

Alternatively, referring to FIG. 3, there can be an array of windows 302 over the cathode 301. Again, a vacuum envelope 306 is utilized to create an environment for the emmission of electrons from the cathode 301 as a result of an application of an electric field. A support structure 303 provides an ability to implement the array of windows 302 through which the beam of electrons 305 passes.

Figure 4:
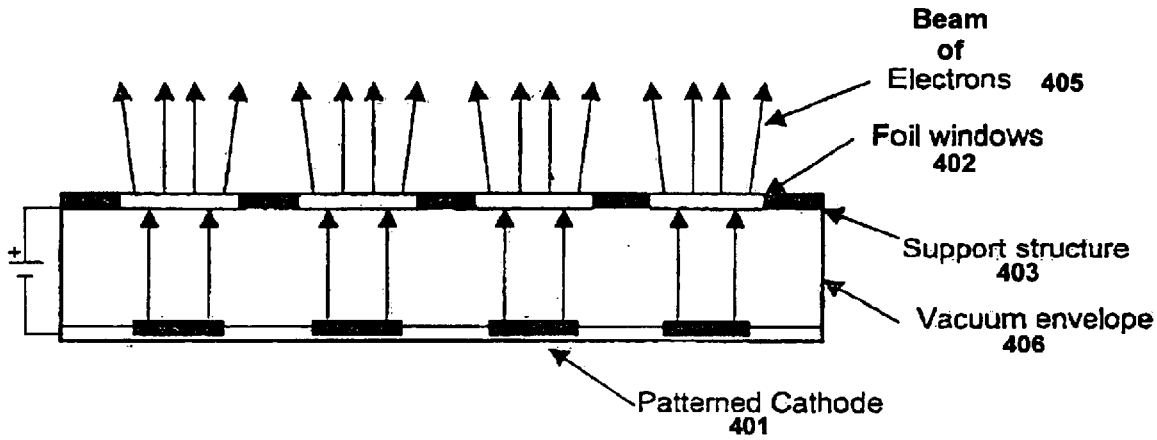
FIG. 4 illustrates a patterned cathode electron source.

Referring to FIG. 4, the cathode 401 can be patterned so that electron emission 405 is localized to specific areas. There is an array of windows 402 such that each window is located opposite each electron source 401 on the cathode substrate. The remainder of the structure in FIG. 4 is similar to that described above with respect to FIGS. 2 and 3.

Figure 5:
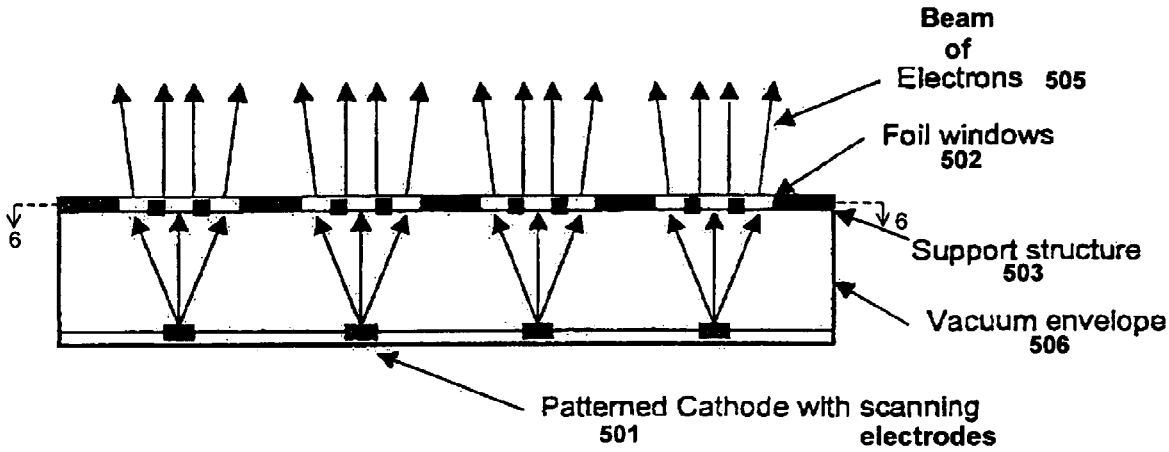
FIG. 5 illustrates a scanned cathode electron source.

Referring to FIG. 5, the cathode 501 can be patterned so that electron beams are created at different locations from the cathode substrate. Each beam can then be scanned over many windows 502 by a deflection mechanism. In this device, there is an array of windows 502 for each electron source 501 on the cathode. The remainder of the structure illustrated in FIG. 5 is similar to that described above with respect to FIGS. 2–4. The deflection mechanism for each pattern cathode 501 can be as described within U.S. Pat. No. 6,441,543, which is hereby incorporated by reference herein.

Figure 6:
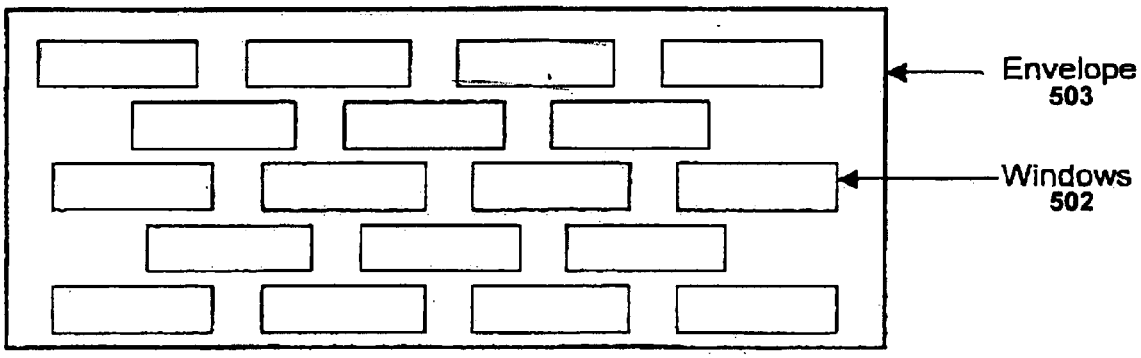
FIG. 6 illustrates staggering of windows for an electron source.

The electron source can be a carbon cold cathode with grid structures for controlling the electron emission. It could also be a microtip array. Referring to FIG. 6, the exit windows 502 can be staggered in the array 503 to fill in dead areas.

Chemical and biological warfare have been released on certain targets within the United States. These attacks have been through the use of sending letters or packages through regular or express mail delivery. There is a need to decontaminate these letters or packages before they are delivered or handled by many people. The present invention provides a way of accomplishing this in a very rapid, "non-destructive" means using a beam of electrons.

Some companies have developed electron lamps that accelerate electrons in a vacuum environment and aim them at a thin metal or semiconducting window. This window is thin enough that many of the electrons pass through while losing a small amount of energy. The environment outside the window could be air or vacuum. Many of these devices are used for exposing polymers to change their properties. Other companies use an electron beam to clean surfaces by placing the surfaces in a vacuum chamber and exposing them to a high energy electron beam inside the vacuum environment. All of these technologies use a hot filament electron source as the source of electrons. They also are used to treat surfaces and not bulk interior or surfaces inside an envelope of any sort.

The present invention can treat multiple surfaces simultaneously (e.g., the outside surface of an envelope plus the inside surfaces and surfaces of sheets of paper or other materials inside) using an electron beam generated from a carbon cold cathode. The carbon cold cathode may consist of carbon nanotubes (single wall and multiwall) and carbon thin films, including diamond-like carbon and mixtures of amorphous carbon, graphite diamond and fullerene-type of carbon materials.

The letters can be treated by a beam of electrons when the letter is either inside or outside of a vacuum environment. Cold cathode sources work better than hot filaments since it is easier to have an extended (or distributed) source of electrons.

Figure 7:
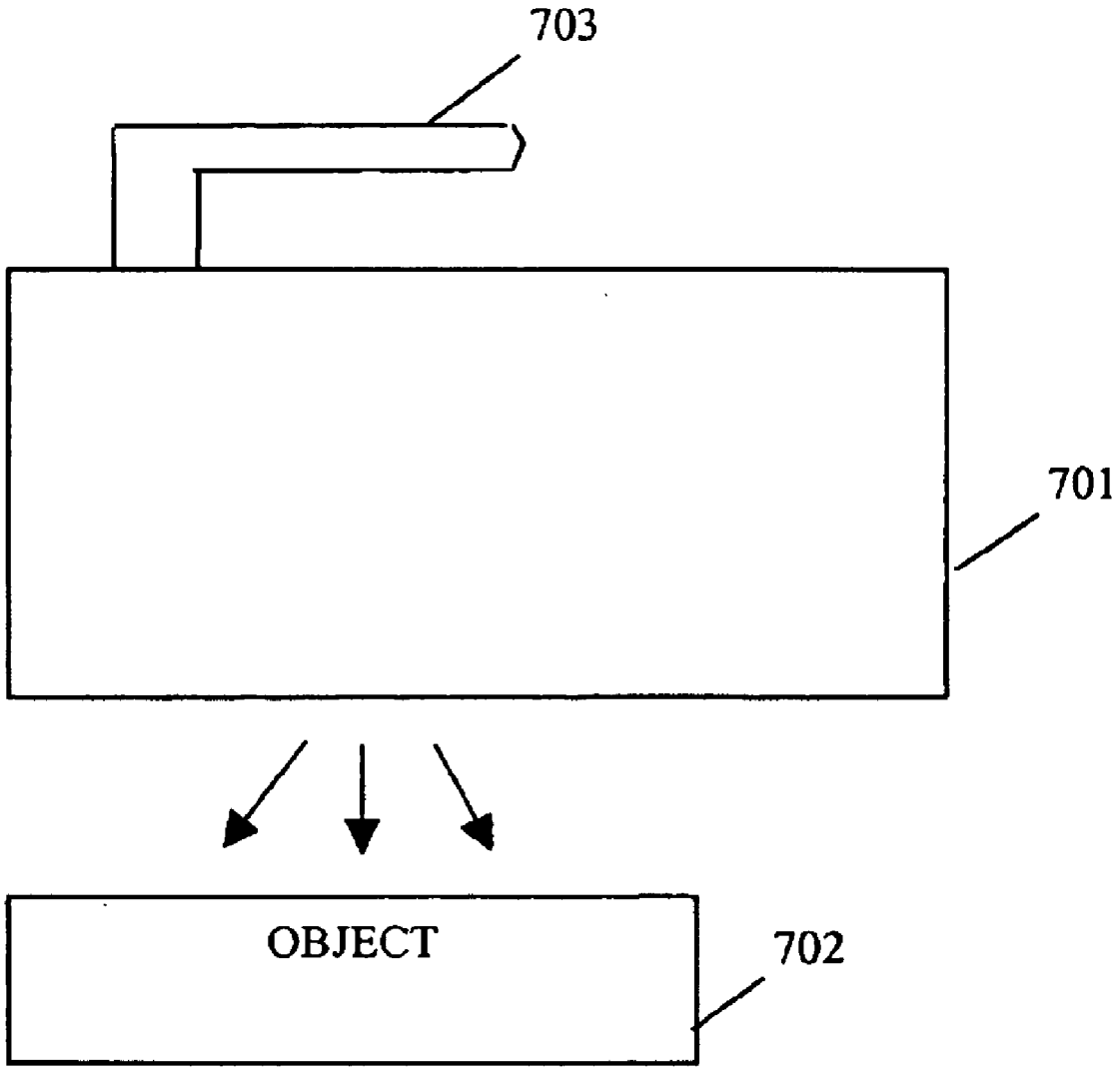
FIG. 7 illustrates a portable electron source.

Referring to FIG. 7, there is illustrated a portable electron beam source 701, possibly having a handle 703. Electron source 701 may comprise any of the electron sources shown in FIGS. 2–6, and could be utilized to radiate object 702 with one or more e-beams.

Figure 8:
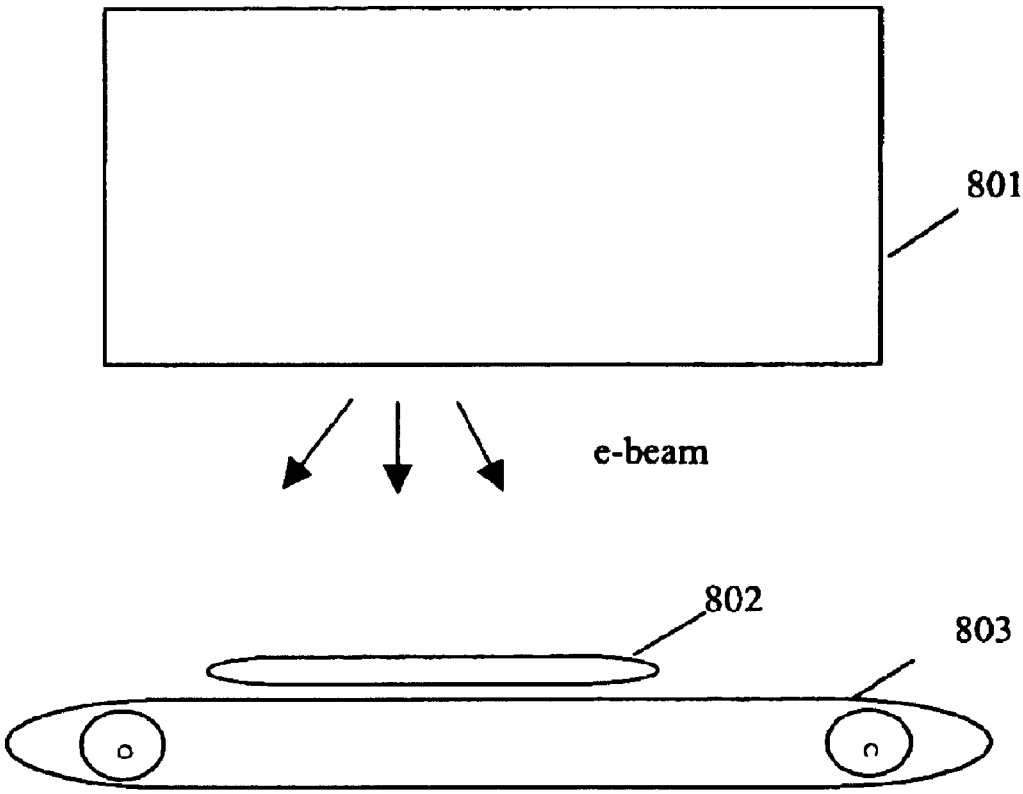
FIG. 8 illustrates decontamination of objects.

Referring to FIG. 8, there is illustrated a method for irradiating objects, such as mail 802, which may pass underneath the electron source 801 on a conveyor belt 803. The electron beams will pass through the envelope. Some energy may be lost at each surface of the letter killing or rendering harmless bacteria or virus species or toxic or other dangerous chemical compounds. Even though the figure shows an electron beam being applied from one side only onto the object, a plurality of e-beam soures can be utilized to arradiate the object 802 from different angles.

It is also possible to place an electron detector or arrays of detectors opposite the source 801 such that one can monitor how much the electron beam is penetrating the envelope 802.

It should be noted that in each of the electron sources shown herein, the e-beam is allowed to pass from the evacuated envelope wherein the cathode is held, out through a window in the envelope so that the electron beams are now passing through the air.

What is claimed is:

1. An electron source comprising:

a plurality of cold cathodes distributed on a substrate;

plurality of windows disposed within a support structure a predetermined distance from the substrate; and scanning electrodes for each of the plurality of cold cathodes, wherein the scanning electrodes are positioned so that each of the plurality of cold cathodes scans one or more electron beams to a plurality of the windows.

2. The electron source as recited in claim 1, wherein the plurality of windows are positioned relative to each other in staggered rows.

3. The electron source as recited in claim 2, wherein a first one of the staggered rows is staggered relative to a second one of the staggered rows.

4. The electron source as recited in claim 2, wherein the plurality of windows enable a substantially uniform beam of electrons to be emitted from the electron source.

5. The electron source as recited in claim 1, wherein the plurality of windows are configured to permit passage of the one or more electron beams.

6. The electron source as recited in claim 5, wherein the plurality of windows each comprise a foil film.

* * * * *